United States Patent [19]

Hamano

[11] 4,192,093

[45] Mar. 11, 1980

[54] TOY CARRIER VEHICLE

[75] Inventor: Nobuo Hamano, Toyko, Japan

[73] Assignee: Tomy Kogyo Co., Inc., Tokyo, Japan

[21] Appl. No.: 962,020

[22] Filed: Nov. 20, 1978

[51] Int. Cl.[2] ..... A63H 11/10

[52] U.S. Cl. ..... 46/204; 46/206

[58] Field of Search ..... 46/202, 201, 204, 206, 46/251, 248; 180/198

[56] References Cited

U.S. PATENT DOCUMENTS

| | | | |
|---|---|---|---|
| 3,594,951 | 7/1971 | Perhacs, Jr. | 46/202 X |
| 4,045,908 | 9/1977 | Ensmann et al. | 46/206 X |

FOREIGN PATENT DOCUMENTS

| | | | |
|---|---|---|---|
| 2205828 | 5/1974 | France | 46/216 |
| 1369134 | 10/1974 | United Kingdom | 46/204 |

*Primary Examiner*—Louis G. Mancene
*Assistant Examiner*—Mickey Yu
*Attorney, Agent, or Firm*—Staas & Halsey

[57] ABSTRACT

A toy carrier vehicle having a cargo portion sufficiently large to accommodate a powered toy vehicle of the type having a spring motor which is wound by rolling the toy vehicle across a level surface. Openings are provided above the drive wheels of the carrier vehicle to allow contact with the drive wheels of the powered vehicle contained therein. Cargo depression members are provided on the carrier vehicle to force the enclosed powered vehicle against the drive wheels of the carrier vehicle as the latter is rolled across a level surface. Upon completion of the winding operation the enclosed powered vehicle can be retained within the cargo portion to power the carrier vehicle, or it can be released for independent travel.

7 Claims, 7 Drawing Figures

TOY CARRIER VEHICLE

BACKGROUND AND SUMMARY OF THE INVENTION

The present invention relates to an unpowered carrier vehicle having a cargo portion sufficiently large to accommodate a powered vehicle of the type having a power source which can be wound by depressing the powered vehicle while rolling it across a floor. The cargo portion of the carrier vehicle of the present invention is provided with openings above the drive wheels, and the powered vehicle can be inserted within the cargo portion with its drive wheels frictionally engaging the drive wheels of the carrier vehicle through these openings. The powered vehicle can be wound while enclosed within the carrier vehicle by depressing members positioned on the top of the carrier vehicle, so as to hold the powered vehicle in a position which allows winding, and rolling the carrier vehicle across the floor. After the powered vehicle has been wound it can be retained within the cargo portion of the carrier vehicle to provide a source of power for the carrier vehicle. Alternately, the powered vehicle can be released from the carrier vehicle to speed away by itself.

The carrier vehicle of the present invention can be used with powered vehicles of the type which can be wound by rotating the drive wheels thereof in either direction, or the type wound by rotating the drive wheels in one direction only. The novel construction of the unpowered carrier vehicle disclosed herein allows a single power source to be used to operate two separate but associated toys. Moreover the present invention allows the unpowered carrier vehicle to be transformed into a powered vehicle by the simple expedient of inserting the powered vehicle into the unpowered vehicle.

DESCRIPTION OF THE PREFERRED EMBODIMENT

Figure 5:
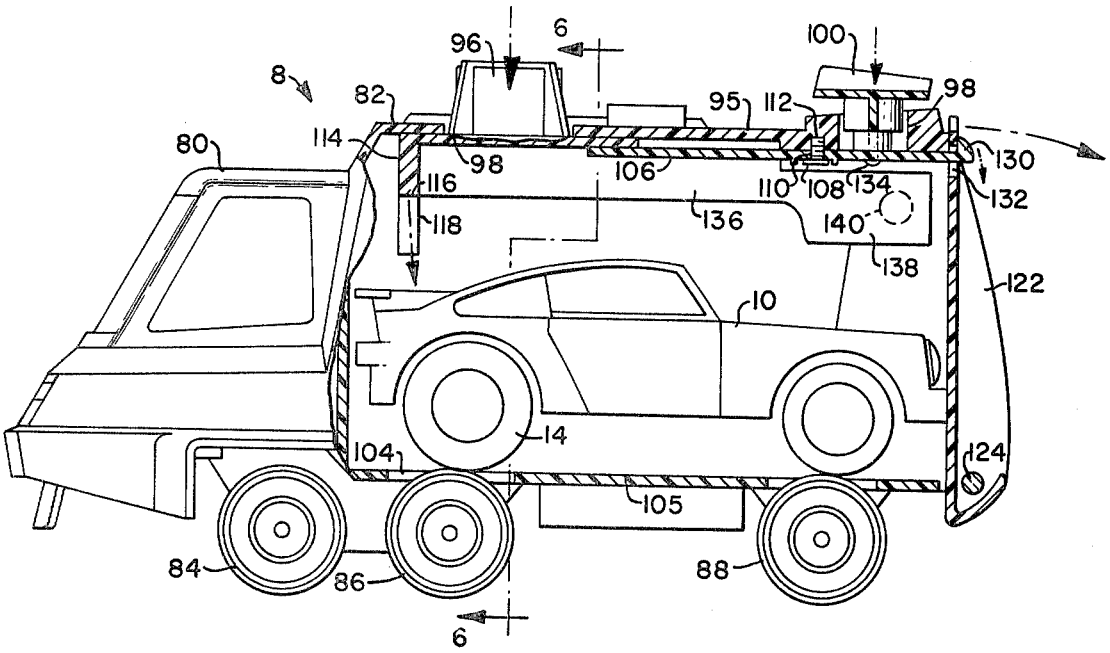
FIG. 5 is a side view partially in section illustrating the powered vehicle within the cargo portion of the unpowered carrier vehicle, the motion of the contact surface which depresses the powered vehicle when the cargo depression members are depressed, and the unlatching of the ramp member when the latch activating member is depressed.

The toy carrier vehicle of the present invention is illustrated in FIG. 5, and consists of an unpowered carrier vehicle 8 having sufficient space therein to accommodate a toy powered vehicle 10. The term "unpowered" refers to the fact that carrier vehicle 8 does not have a source of power permanently attached to it, but instead co-operates with powered vehicle 10 when it is contained within carrier vehicle 8. Power vehicle 10 per se is distinct from the present invention.

A powered vehicle of the type which can be used with the toy carrier vehicle of the present invention is designated generally by the reference number 10 in FIGS. 1 through 4, and includes front wheels 12, rear or drive wheels 14 and a chasis 16 to which the subject gearing mechanisms are mounted. The chassis 16 consists of walls 18, 20 and 22 which are positioned in spaced relationship with the elements 24.

Figure 4:
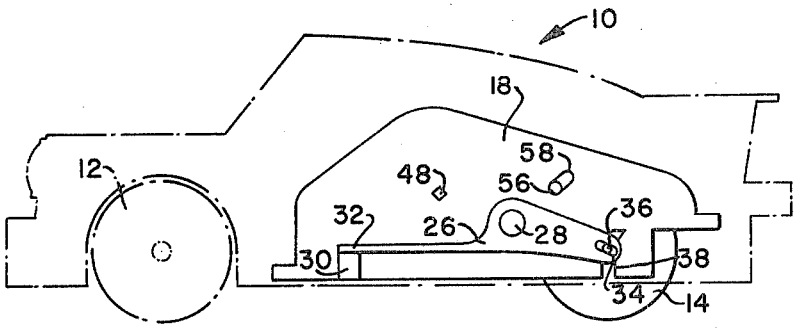
FIG. 4 is a side elevational view of the chasis within which the gearing mechanisms are mounted, illustrating in particular the spring plate which normally biases the rear axle to which the wheels are attached downwardly out of engatement with the gear trains.

As illustrated in FIG. 4, there is positioned on the outside of each of the walls 18 and 22 a spring plate 26 which is mounted freely about a shaft 28 extending outwardly from the walls 18 and 22. Abutments 30 extend outwardly from the walls 18 and 22 engaging the forward ends 32 of the plates 26. The other ends of the plates 26 are formed with slotted openings 34 through which the ends of the axle 36, to which the rear wheels 14 are rigidly mounted, extend. The walls 18 and 22 are provided with slots 38 through which the ends of the axle 36 extend such that it is possible when pressing downwardly against the top of the vehicle 10 to move the axle 36 upwardly within the slots 38 for the purpose of engaging the gearing mechanisms to be described hereinafter, during which time the mid-section of the spring plate 26 bends. Release of the top of the vehicle 10 permits the resilient characteristics of the plates 26 to return the axle 36 to its original position midway of the slots 38, as illustrated in FIG. 4.

Mounted to the chassis 16 is a casing 42 within which a coiled spring 44 is located. One end 46 of the coiled spring 44 is attached to a shaft 48 which extends through the walls 18, 20 and 22 while the other end 49 thereof is attached to the casing 42. The gears 50 and 52 are also securely mounted to the shaft 48 so as to rotate therewith.

Figure 3:
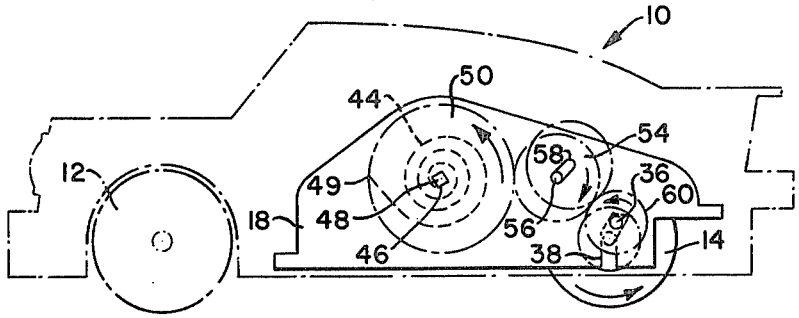
FIG. 3 is a sectional view taken along line 3—3 of FIG. 1, illustrating the other of the gear trains which operatively winds the energy storing spring when the powered vehicle is pressed downwardly and moved forwardly.

It will be apparent from FIG. 3 that a gear wheel 54 is attached to a shaft 56, the ends of which are mounted with slots 58 within the walls 18 and 20, thus permitting the gear 54 to move as the shaft 56 moves within the slots 58. A gear 60 is mounted to the axle 36. From the foregoing it will be apparent that when the vehicle is pressed downwardly and moved forwardly as illustrated in FIG. 3, the counter-clockwise rotation of the rear wheels 14 and the axle 36 causes the gear 60 to rotate counterclockwise and be brought into engagement with the gear 54, at which time the shaft 56 moves downwardly within the slots 58 bringing the gear 54 into engagement with the gear 50 which, in turn, rotates the shaft 48 coiling the spring 44 and storing energy therein.

Figure 1:
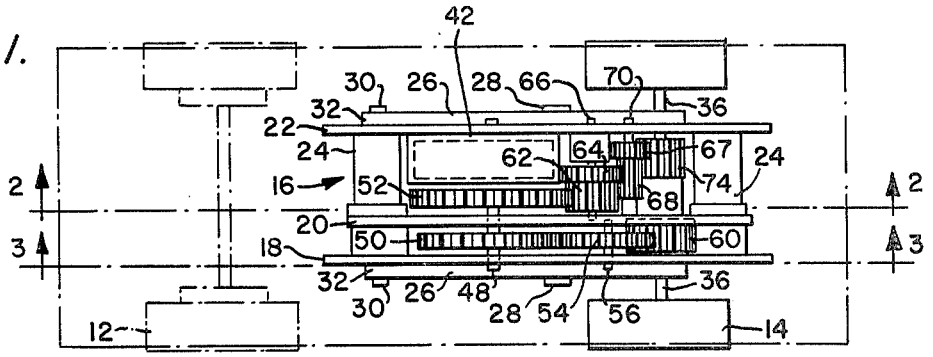
FIG. 1 is a top plan view of a powered vehicle, illustrating in particular the chasis and the dual gearing mechanisms mounted therein.
Figure 2:
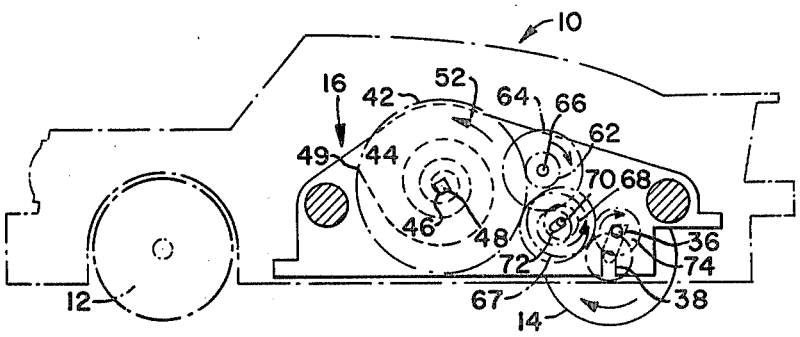
FIG. 2 is a cross-sectional view taken along line 2—2 of FIG. 1, illustrating one of the gear trains which operatively winds the energy storing spring when the powered vehicle is pressed downwardly and moved rearwardly.

As illustrated in FIG. 2, the gears 62 and 64 are unitary in construction and mounted to a shaft 66 which is appropriately journaled between the walls 20 and 22. In similar manner, the gears 67 and 68 are unitary in construction and mounted to a shaft 70, the ends of which are mounted within elongated slots 72 provided within the walls 20 and 22, thus permitting the shaft 70 to move up and down within the slots 72. Finally, the gear 74 is fixedly secured to the axle 36. Thus, as the vehicle 10 is pressed downwardly and moved rearwardly as illustrated in FIG. 2, the clockwise rotation of the rear wheels 14 causes the axle 36 and the gear 74 attached thereto to turn clockwise. The rotating gear 74 meshes with the gear 67 urging the shaft 70, to which the gears 67 and 68 are attached, to move upwardly thus forcing the gear 68 into engagement with the gear 64 and thus rotating the gear 64 clockwise. The similarly clockwise rotating gear 62 meshes with the gear 52, rotating same counterclockwise and coiling the spring 44 to store energy therein. From the foregoing, it will be apparent that both the forward and rearward movement of the vehicle 10 causes the spring 44 to be coiled within the casing 42.

It will also be apparent from FIG. 3 that during the time the vehicle is being moved rearwardly (FIG. 2), the shaft 56 moves upwardly within the slots 58, disengaging the gears 50 and 54. In similar manner, it will be apparent from FIG. 2 that when the vehicle is moved forwardly (FIG. 3) the shaft 70 moves downwardly within the slot 72 disengaging the gears 67 and 74. In this manner, there is no interference between the gearing mechanisms when the vehicle is moved forwardly and rearwardly.

It will be understood, of course, that upon releasing the vehicle 10 the spring plates 26 assume their normal positions causing the axle 36 to move downwardly within the slots 38 to resume their normal position, at which time the gears 60 and 74 are disengaged from the gears 54 and 67, respectively, after which the shaft 48 is rotated in a clockwise direction under the influence of the energy stored in the spring 44. This causes the gears 62 and 64 to rotate counterclockwise, at which time the gear 64 engages the gear 68 causing same to rotate clockwise, at which time the shaft 70 moves upwardly within the slots 72. The clockwise rotation of the gear 67 causes the gear 74, which meshes therewith and which is attached to the axle 36, to rotate in a counterclockwise direction, thus causing the counterclockwise rotation of the wheels 14 to propel the vehicle 10 forwardly.

It will be apparent from the above description that spring 44 of powered vehicle 10 can be wound by depressing the vehicle and rotating rear wheels 14 in either direction. When the vehicle is released spring 44 is unwound, turning rear or drive wheels 14 in the direction (counterclockwise in FIG. 3) which will move vehicle 10 forward, if it is free to move. The fact that power can be delivered to rear wheels 14 by turning them in either direction, and that the power released by spring 44 turns rear wheels 14 in one direction only, allows powered vehicle 10 to operate either as an independent vehicle or as the power source for unpowered carrier vehicle 8. The mechanisms which allow this dual use of the power source within powered vehicle 10 will now be described.

Turning now to FIG. 5, carrier vehicle 8 is provided with cab portion 80 and cargo portion 82, which has sufficient space therein to accommodate the powered vehicle 10 selected. Vehicle 8 is also provided with pairs of wheels 84, 86, and 88 which are suitably journaled for rotation. Wheels 86 are the drive wheels.

Figure 7:
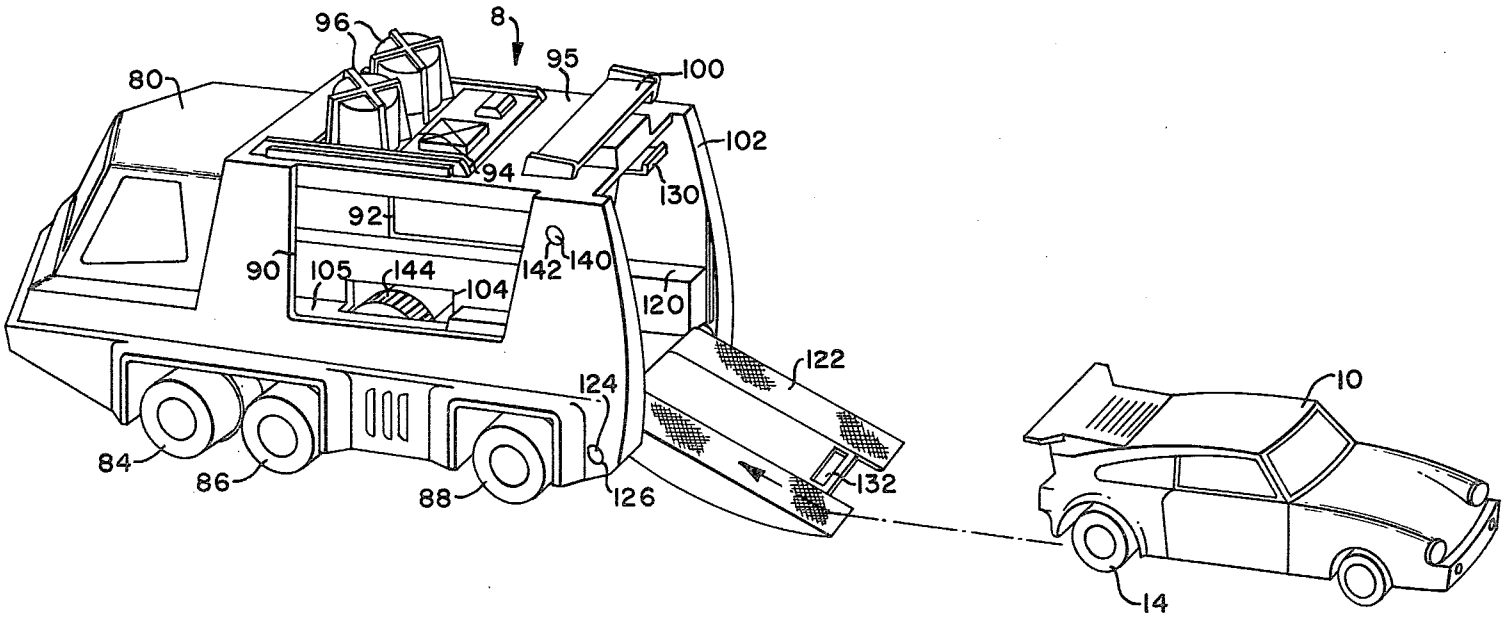
FIG. 7 is a perspective view of the carrier vehicle of the present invention with its ramp member lowered to allow the powered vehicle to be loaded.

As illustrated in FIG. 7 cargo portion 82 is provided with windows 90 and 92, rectangular opening 94 in top 95 through which cargo depression members 96 extend, opening 98 (best illustrated in FIG. 5) through which latch activating member 100 extends, cargo access opening 102, and two drive wheel openings 104 in the floor 105 which allow rear or drive wheels 14 a powered vehicle 10 to engage wheels 86 of carrier vehicle 8. It will be apparent from the figures that, although cargo depression members 96 and latch activating member 100 are functional, they can easily be disguised to attractively resemble operative elements of a real vehicle.

Figure 6:
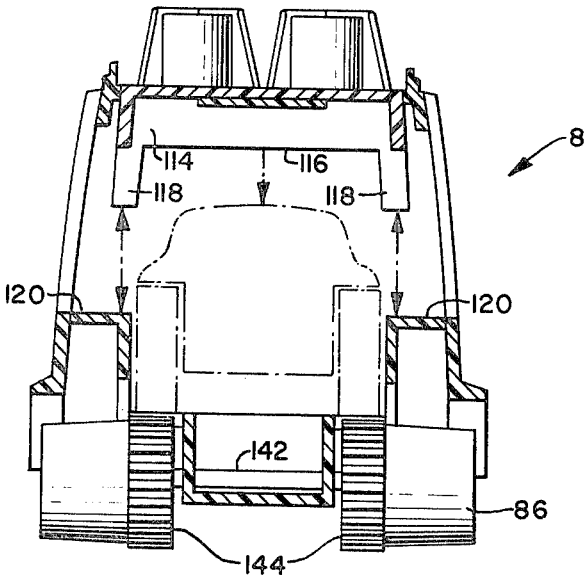
FIG. 6 is a sectional rear view taken along the dot-dash line 6—6 in FIG. 5.

Returning now to FIG. 5, the cargo depression members 96 are fixedly attached to resilient plastic member 106, which extends beneath the roof of cargo portion 82 and is mounted thereto by screw 108, which extends through mounting hole 110 in member 106 and into threaded screw hole 112 in cargo portion 82. Toward the cab portion 80 of carrier vehicle 8, resilient plastic member 106 is provided with end portion 114 having contact surface 116 and two legs 118. It will be apparent that, when powered vehicle 10 is within carrier vehicle 10, depression of members 96 will bend resilient plastic member 106 downward so that contact surface 116 engages vehicle 10 and exerts downward pressure on it near rear wheels 14. As illustrated in FIG. 6, the interior of the cab portion 82 is provided with walls 120, which not only insure that vehicle 10 is properly positioned when it is within carrier vehicle 8, but which also provide a surface for engaging legs 118 to prevent excessive pressure from being applied to vehicle 10. When vehicle 10 is not within vehicle 8, legs 118 infringe upon walls 120 to prevent resilient plastic member 106 from being broken from inadvertent depression of members 96.

At the rear of cargo portion 82, the ramp member 122 is pivotably mounted to vehicle 8 by pin 124, which extends through holes 126 in cargo portion 82 and tunnels 128 (not shown) at one end of member 122. It will be apparent from FIG. 7 that when ramp member 122 is extended outward power vehicle 10 can be easily rolled into the interior of cab portion 80. As is seen in FIG. 5, ramp member 122 can be folded up to securely enclose vehicle 10 within vehicle 8. A hook 130 provided at one end of plastic member 106 is positioned to engage slot 132 in ramp member 122 so as to lock the latter when it is closed. It will be apparent that depression of latch activating member 100, which is fixedly attached to member 106 by screw 134, will disengage hook 130 from slot 132 and allow ramp member 122 to be lowered. Flanges 136 on either side of member 106 are provided with projections 138 having mountings cylinders 140 extending from them. As is seen on FIG. 7, mountings cylinders 140 pivotably engage holes 142 and thereby guide the movement of resilient plastic member 106 which it is depressed.

Turning now to FIG. 6, it will be apparent that drive wheels 86 are pivotably mounted on axle 142 and are provided with toothed surfaces 144 to reduce friction as the wheels 86 engage rear wheels 14 of vehicle 10 through openings 104 in cargo portion 82.

With reference to FIG. 5 the operation of carrier vehicle 8 can now be described. A child can wind spring 44 within vehicle 10 by depressing members 96 as he grasps vehicle 8 and rolls it along a level surface. The rotary movement thereby imparted to wheels 86 is frictionally transferred to wheels 14 of vehicle 10, which is held in a depressed (winding) state due to the force exerted by contact surface 116. Since rotation of wheels 14 in either direction will wind spring 44, it is apparent that spring 44 can be wound by moving vehicle 8 by either backwards or forwards. Upon completion of the winding process vehicle 8 can be released and the resiliency of member 106 will withdraw contact surface 116 from vehicle 10, whose rear wheels 14 will begin rotating clockwise (as shown in FIG. 5). This rotation of rear wheels 14 will impart a counterclockwise (as shown in FIG. 5) rotation to wheels 86 and drive vehicle 8. Vehicle 10 should, of course, be sufficiently heavy to ensure adequate traction against toothed surfaces 114. Alternately, latch activating member 100 can be depressed to unlock ramp member 122 and allow power vehicle 10 to speed off. In summary, an unwound powered vehicle 10 can be wound by inserting it in an unpowered carrier vehicle and treating the latter, in essence, as a powered vehicle. Upon completion of a winding operation the unpowered carrier vehicle 8 can continue to operate as a power vehicle by keeping the powered vehicle 10 enclosed within cargo portion 82. Alternately, the child may release the now-wound vehicle 10 to speed away under its own power.

Although the operation of the unpowered carrier vehicle of the present invention has been described in conjunction with a power vehicle 10 having a spring motor which can be wound by rotating rear wheels clockwise or counterclockwise, it will be apparent to those skilled in the art that other types of powered vehicles can be used. For example, a powered vehicle of the type which can be wound by rotating the rear wheels in one directiononly could be used. Moreover, it is unimportant whether the powered vehicle 10 uses a spring such as spring 44 to store energy, or some other means such as rubber bands. As electrically powered vehicle 10 could be used but, of course, could not be energized by rolling unpowered carrier vehicle 8.

I claim:

1. An unpowered toy carrier vehicle for use with a powered toy vehicle, said powered toy vehicle being of the type which can be energized by exerting force on the top of the vehicle and rotating the drive wheels thereof, comprising:

a toy vehicle having a cargo portion sufficiently large to accommodate said powered toy vehicle, said cargo portion having a floor with two openings therein and a top with a first opening therein;

two drive wheels, each of said drive wheels being mounted for rotation beneath the openings in the floor of said cargo portion;

means for allowing said powered toy vehicle to be inserted into said cargo portion and positioned with its drive wheels communicating with said drive wheels mounted beneath the openings in the floor of said cargo portion; and means for exerting force on the top of said powered vehicle when it is within said cargo portion, said means for exerting force on the top of said powered toy vehicle comprising an elongated resilient member mounted within said cargo portion on the top thereof, at least one cargo depression member fixedly attached to said elongated resilient member and extending through the first opening in said top of said cargo portion, and an end member fixedly mounted to said resilient member, said end member having a contact surface configured to engage the top of said powered toy vehicle when said powered toy vehicle is within said cargo portion.

2. The unpowered toy carrier vehicle of claim 1, further comprising at least one wall fixedly mounted within said cargo portion, and wherein said means for exerting force on the top of said powered toy vehicle further comprises at least one leg fixedly attached to said resilient member above said at least one wall.

3. The unpowered carrier vehicle of claim 1, wherein said cargo portion has an access opening through which said powered toy vehicle can be moved, and further comprising a ramp member having an opening therein, said ramp member being pivotably mounted to said cargo portion at the bottom of the access opening, and a hook on said elongated resilient member positioned to engage the opening in said ramp member.

4. The unpowered carrier vehicle of claim 3, wherein said top of said cargo portion has second opening adjacent to said access opening, and further comprising a latch activating member fixedly mounted to said resilient member through said second opening.

5. An unpowered toy carrier vehicle for use with a powered toy vehicle, said powered toy vehicle being of the type having a spring motor which can be energized by exerting force on the top of the vehicle and rotating the drive wheels thereof, comprising:

a toy vehicle having a cargo portion sufficiently large to accommodate said powered toy vehicle, said cargo portion having a floor with two openings therein;

two drive wheels, each of said drive wheels being mounted for rotation beneath the openings in the floor of said cargo portion;

means for allowing said powered toy vehicle to be inserted into said cargo portion and positioned with its drive wheels communicating with said drive wheels mounted beneath the openings in the floor of said cargo portion; and means for exerting force on the top of said powered vehicle when it is within said cargo portion so that said spring motor will be energized as said toy vehicle is manually moved across a surface.

6. The unpowered toy carrier vehicle of claim 1, wherein each of said two drive wheels is provided with toothed surfaces around the periphery thereof.

7. An unpowered toy carrier vehicle for use with a powered toy vehicle, said powered toy vehicle being of the type which can be energized by exerting force on the top of the vehicle and rotating two drive wheels thereof, comprising:

a toy vehicle having a cargo portion sufficiently large to accommodate said powered toy vehicle, said cargo portion having a floor with two openings therein, a top having first and second openings therein, and an access opening through which said powered toy vehicle can be moved;

two drive wheels, each of said drive wheels being mounted for rotation beneath the openings in the floor of said cargo portions;

means communicating through said two openings in said floor of said cargo portion for transmitting rotary energy between said two drive wheels mounted beneath the openings in the floor of said cargo position and said powered toy vehicle when said powered toy vehicle is positioned within said cargo portion;

means for exerting force on the top of said powered vehicle when it is positioned within said cargo portion, said means for exerting force comprising an elongated resilient member mounted within said cargo portion at the top thereof and having an end member with a contact surface configured to engage the top of said powered toy vehicle when said powered toy vehicle is positioned within said cargo portion, and at least one cargo depression member fixedly attached to said resilient member through said first opening in the top of said cargo portion;

a ramp member having an opening therein, said ramp member being pivotably mounted to said cargo portion at the bottom of the access opening;

a hook mounted to said elongated resilient member and positioned to engage the opening in said ramp member; and a latch activating member fixedly mounted to said resilient member through said second opening in said top of said cargo position.

* * * * *